US005896897A

United States Patent [19]

Lewis et al.

[11] Patent Number: 5,896,897

[45] Date of Patent: Apr. 27, 1999

[54] FILLING VALVE

[76] Inventors: David Lewis; Donald Walden, both of 4335 Bodega Ave., Petaluma, Calif. 94952

[21] Appl. No.: 08/982,794

[22] Filed: Dec. 2, 1997

[51] Int. Cl.[6] ..... B65B 31/00

[52] U.S. Cl. ..... 141/39; 141/44; 141/50; 141/59; 141/301; 141/302; 141/307

[58] Field of Search ..... 141/39, 40, 44–47, 141/49, 50, 54, 57, 59, 301, 302, 305, 307

[56] References Cited

U.S. PATENT DOCUMENTS 3,797,535 3/1974 Kaiser ..... 141/46

4,924,921 5/1990 Simmel et al. ..... 141/302

5,474,113 12/1995 Rademacher et al. ..... 141/39

*Primary Examiner*—David J. Walczak

*Assistant Examiner*—Timothy L. Maust

*Attorney, Agent, or Firm*—Goldstein & Canino

[57] ABSTRACT

The invention is a filling valve which mounts to a filling machine having a storage tank for filling bottles or containers with liquid. The liquid passage of the filling valve is formed by a valve stem detachably connected with a sleeve. The two-piece design permits easy cleaning, replacing, and interchanging of the valve parts. The sleeve and valve stem are provided with large diameter bores in order to maximize fluid flow and minimize fill time. The bores of the sleeve and valve stem are provided with smooth tapered surfaces to reduce liquid turbulence.

4 Claims, 4 Drawing Sheets

FILLING VALVE

BACKGROUND OF THE INVENTION

This invention relates to a filling valve for filling containers with liquid. More particularly, the invention relates to a filling valve having a liquid passage defined by two detachable parts, a sleeve and valve stem, designed for easy interchanging, replacement and cleaning of its parts.

Liquid filling valves are used with filling machines in the bottling industry to fill containers with wine, water, olive oil, or the like. It is often desirable to fill containers with liquids quickly, to increase productivity of the filling machine. Moreover, it is often desirable to reduce liquid turbulence during the filling process in order to minimize oxygen pick up between the storage tank and the bottle; the liquid turbulence can be especially troublesome when filling a bottle with products such as wine. Furthermore, it is often necessary and desirable to sanitize valve parts, to replace broken valve parts, and to interchange valve parts to accommodate different types of containers.

Many existing filling valves have narrow liquid passageways which impede liquid flow, thereby extending the time for filling a container and limiting productivity of the filling machine. Additionally, in the existing filling valves, the liquid must often follow a path having ridges, resulting in increased turbulence to the liquid and corresponding oxygen build up in the liquid between the storage tank and a bottle. Moreover, the parts of the existing valves which contain the liquid passageway are not detachable. This not only give arise to a liquid passageway which is troublesome to access and difficult to sanitize, but also accounts for the inability to replace damaged valve parts and inability to interchange valve parts to accommodate containers of different sizes and shapes.

While these units mentioned above may be suitable for the particular purpose employed, or for general use, they would not be as suitable for the purposes of the present invention as disclosed hereafter.

SUMMARY OF THE INVENTION

It is an object of the invention to provide a filling valve having a liquid passage defined by two detachable parts, a sleeve, and a valve stem, designed to facilitate easy interchanging of valve parts, easy replacement when a valve tip bends or breaks off, and easy cleaning.

It is another object of the invention to provide a filling valve having a liquid passage defined by internal surfaces which are smooth and tapered with no ridges, to reduce turbulence and minimize oxygen pick up between the storage tank and a container to be filled.

It is a further object of the invention to provide a filling valve comprising sleeve and valve stem bores with large diameters allowing a fluid flow capacity greater than that of the existing filling valves, thereby increasing fill speed and productivity of the filling machines.

The invention is a filling valve which mounts to a filling machine having a storage tank for filling bottles or containers with liquid. The liquid passage of the filling valve is formed by a valve stem detachably connected with a sleeve. The two-piece design permits easy cleaning, replacing, and interchanging of the valve parts. The sleeve and valve stem are provided with large diameter bores in order to maximize fluid flow and minimize fill time. The bores of the sleeve and valve stem are provided with smooth tapered surfaces to reduce liquid turbulence.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
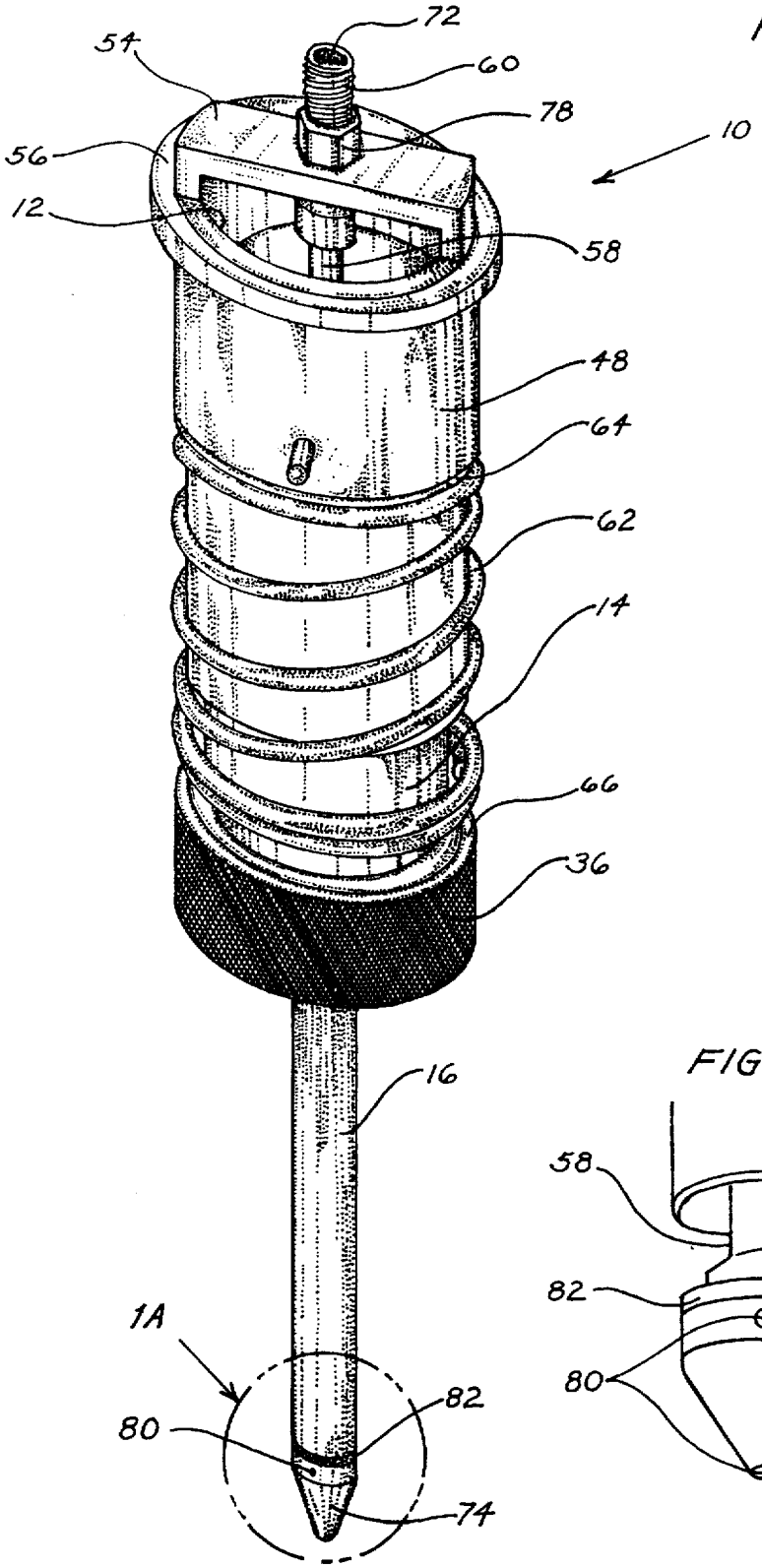
FIG. 1 is a diagrammatic perspective view of the instant invention during a non-filling operation.

FIG. 1 illustrates a filling valve 10 which is used with a filling machine having a storage tank, for filling bottles or containers with liquid. The filling valve 10 has primary components including a main body 48 which is capable of being secured to a filling machine and a sleeve 14 slidably mounted within the main body 48. The sleeve 14 along with the valve stem 16 attached thereto is capable of moving up and down with respect to the main body 48. A vent tube 58 extends coaxially with the main body 48, sleeve 14, and valve stem 16, and is affixed to the main body 48 for evacuating the air contained in a container during the filling operation.

Figure 1A:
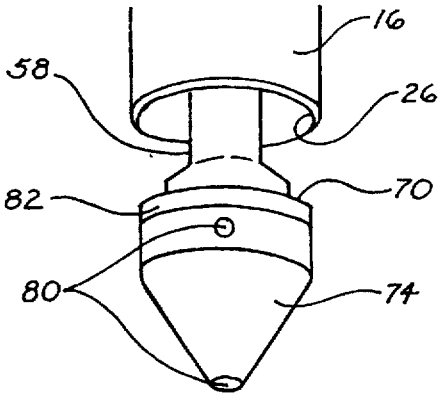
FIG. 1A is a diagrammatic perspective view of the vent tube and the valve stem during a filling operation: an enlargement of the area indicated in circle 1A in FIG. 1.

During a filling operation, the valve stem 16 is inserted downward into the container, through its mouth. Whereupon, the valve stem 16 is manually raised by the mouth of the container, forming a liquid passage opening between the lower end of the valve stem 16 and the vent tube seal 82, as depicted in FIG. 1A and 2A. The opening allows the container to be filled with the liquid flowing from the storage tank through the sleeve 14 and the valve stem 16 into a container. After the container has been filled with sufficient amount of liquid, the container is lowered from the filling valve 10, causing a compression spring 62 acting between the main body 48 and the sleeve 14 to press downwardly against the valve stem 16 closing the liquid passage opening between the lower end of the valve stem 16 and a vent tube seal 82, thereby interrupting the fluid flow from the valve stem 16 to the container.

Figure 3:
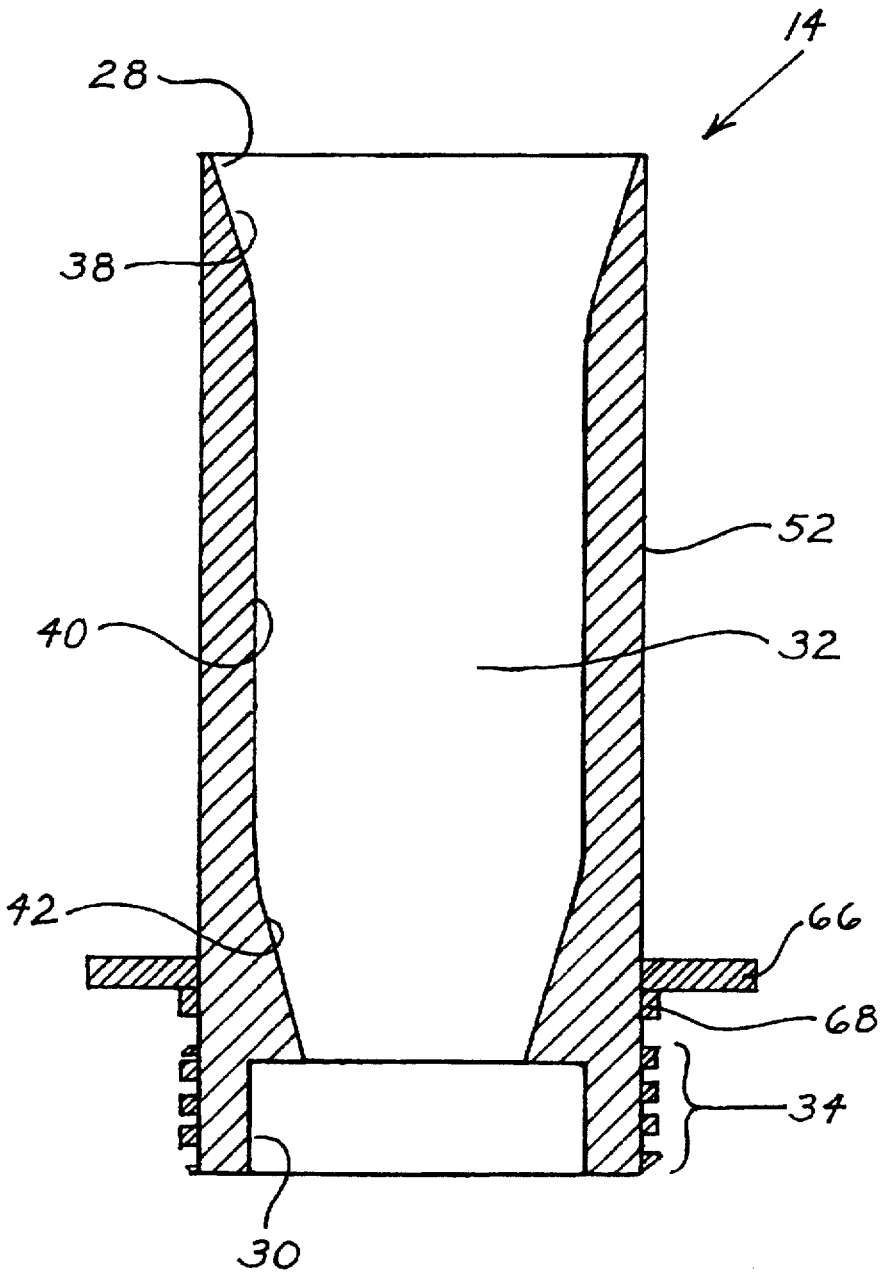
FIG. 3 is a cross-sectional elevational view of the sleeve of the instant invention.
Figure 4:
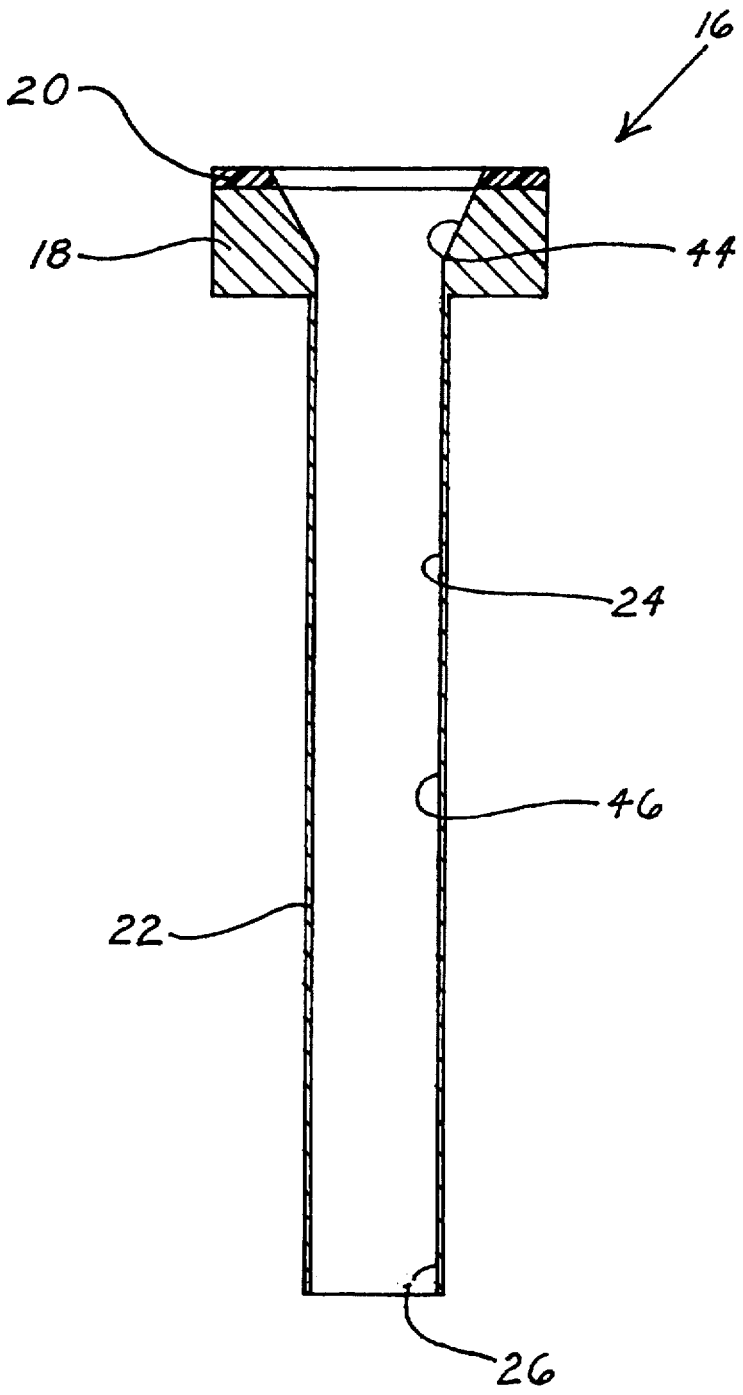
FIG. 4 is a cross-sectional elevational view of the valve stem of the instant invention.

The sleeve 14 and the valve stem 16 are detachably engaged. The valve stem 16 includes a head portion 18 which is provided with an annular seal 20 to prevent leakage of fluid between the valve stem 16 and the sleeve 14, and a tubular portion 22 which extends downwardly from the head portion 18, as shown in FIG. 4. The sleeve 14 has an overall cylindrical shape and has a first opening 28 in fluid communication with the storage tank and a second opening 30 sized and shaped to receive the head portion 18 of the valve stem 16, as shown in FIG. 3. The second opening 30 has a diameter substantially the same as that of the head portion 18 such that the head portion 18 firmly engages therein.

Figure 2:
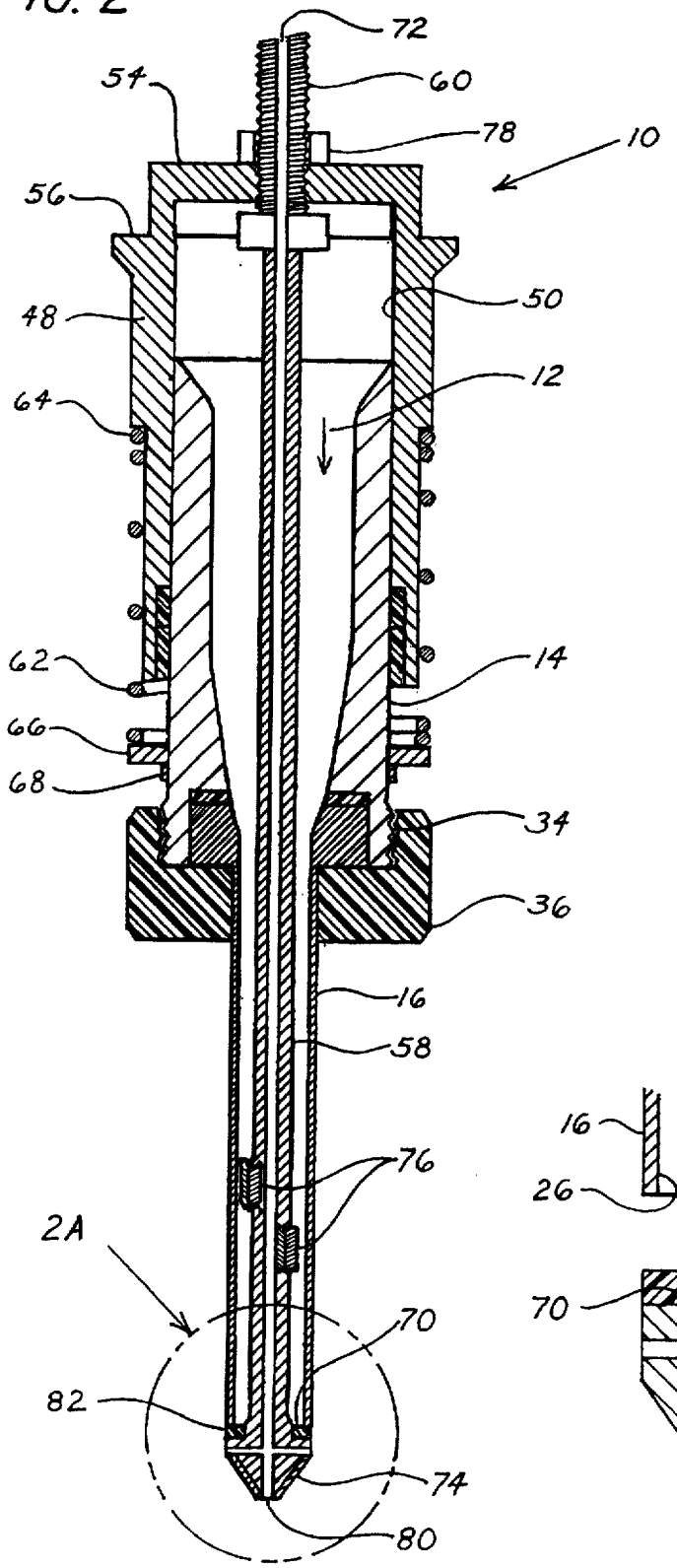
FIG. 2 is a cross-sectional elevational view of the instant invention during a non-filling operation.
Figure 2A:
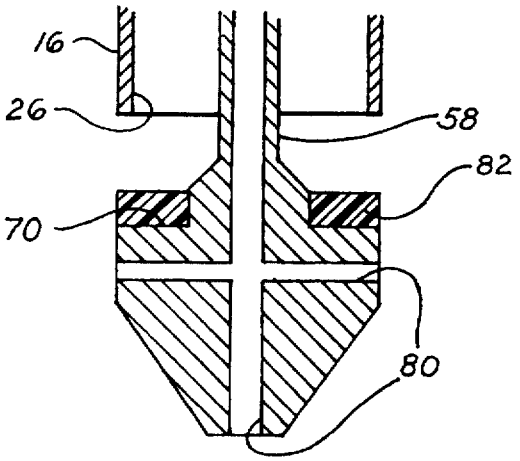
FIG. 2A is a cross-sectional elevational view of the vent tube and the- valve stem during a filling operation: an enlargement of the area indicated in circle 2A in FIG. 2.

FIGS. 1 and 2 illustrate a sleeve nut 36 being used to secure the valve stem 16 to the sleeve 14. The sleeve nut 36 is internally threaded which is in operative engagement with an externally threaded portion 34 of the sleeve 14. The sleeve nut 36 is open at its center for the passage of the tubular portion 22 of the valve stem 16. The head portion 18 of the valve stem 16 is secured to the second opening 30 of the sleeve 14 by tightening the sleeve nut 36 onto the sleeve's threaded portion 34.

This detachable configuration of the sleeve 14 and the valve stem 16 facilitates easy replacement of valve parts when it bends or breaks off, and allows one to easily sanitize valve parts and the liquid passage of the filling valve. Furthermore, because the valve stem 16 is detachable, it can be easily interchanged with a valve stem of different size in order to conveniently accommodate filling of different type and size containers.

FIG. 2 illustrates a liquid passage 12 of the filling valve being defined by the sleeve 14 and the valve stem 16 through which liquid flows from the storage tank to a container. FIGS. 2, 3, and 4 illustrate an upper portion of the liquid passage 12 being defined by a sleeve bore 32 and a lower portion of the liquid passage 12 being defined by a valve stem bore 24. The valve stem bore 24 extends vertically and has a valve outlet 26 opposite the head portion 18. The sleeve bore 32 extends vertically between the first and second openings 28 and 30. In order to increase filling speed, the sleeve bore 32 has a larger diameter than the prior art designs, increasing fill speeds by 30% to 40% compared to the existing filling valves, thereby increasing productivity of the filling machines.

The details of the sleeve bore 32 and valve stem bore 24 are shown in FIG. 3 and 4, and include the following interior portions: a first conical sleeve portion 38, a cylindrical sleeve portion 40, a second tapered conical sleeve portion 42, a conical valve stem portion 44, and a cylindrical valve stem portion 46. The sleeve and valve stem portions 38–46 have smooth and tapered surfaces which define the axial liquid passage 12, through which liquid flows from the storage tank to a container. The smooth and tapered interior surfaces have no ridges facilitating a smooth flow of liquid through the axial liquid passage 12 of the sleeve 14 and valve stem 16 to the container, thereby reducing liquid turbulence and minimizing oxygen pick up between the storage tank and a container.

FIGS. 1 and 2 illustrate the main body 48 having a cylindrical vertical bore 50 extending the length thereof adapted to slidably engage with the exterior sides 52 of the sleeve 14. The main body 48 has a bridge member 54 permanently attached to the top annular surface 56 thereof. The bridge member 54 has a center opening for passage of a threaded end 60 of vent tube 58, yet to be described.

The vent tube 58 has a top portion provided with a vent opening 72 and a conical-shaped portion 74. The vent tube 58 extends coaxially with the main body 48, sleeve 14, and valve stem 16 and has a plurality of spacing members 76 projecting outwardly to keep the vent tube 58 centered within the valve stem bore 24. The top portion of the vent tube 58 is threaded 72 and is attached to the bridge member 54 of the main body 48 by affixing a nut 78 thereto.

The vent tube 58 is hollow to provide for the evacuation of air contained in the container during a filling operation. The conical-shaped portion 74 has apertures 80 at the sides and bottom thereof to permit air to pass into and out of the vent tube, as depicted in FIG. 1 and 2. The conical-shaped portion 74 has a shoulder 70 which is provided with the vent tube seal 82 to prevent liquid leakage between the valve outlet 26 and the vent tube shoulder 70 during the non-filling period.

FIG. 1 illustrates the compression spring 62 acting between a lip 64 projecting from the main body 48 and a spring seat 66 radially mounted about the sleeve 14. The spring seat 66 is clamped between the spring 62 and a flange 68 which extends radially from the sleeve 14 immediately above the externally threaded portion 34, as shown in FIG. 2. When no external force is exerted on the filling valve 10, the spring 62 retained by the lip 64 of the main body 48 at one end pushes downwardly against the spring seat 66 at the other end. This causes the sleeve 14 and valve stem 16 to push downwardly against the vent tube shoulder 70, thereby establishing the closure position of the filling valve 10.

To fill a container with liquid, the mouth of the container is pushed upwardly against the sleeve nut 36 compressing the spring 62, which lifts the valve stem 16 frpm the vent tube shoulder 70 creating an liquid passage opening between the valve outlet 26 and the vent tube seal 82, through which liquid is permitted to flow into the container, as depicted in FIG. 1A and 2A. As the container is filling with liquid, the air contained in the container is evacuated through the vent tube 58. As soon as the predetermined level of liquid in the container is reached, the liquid passage is closed stopping the flow of liquid into the container. The closure of the liquid passage is achieved by lowering the container from the filling valve 10, whereby the spring 62 expands pushing downwardly against the sleeve 14 and valve stem 16 establishing a seal between the valve outlet 26 and the vent tube seal 82, as depicted in FIG. 1.

Many specific details contained in the above description merely illustrate some preferred embodiments and should not be construed as a limitation on the scope of the invention.

What is claimed is:

1. A filling valve for filling a container with liquids from a storage tank containing liquid, comprising:

a) an interchangeable valve stem having a head portion and a tubular portion extending downwardly from the head portion, said valve stem having a valve stem bore extending vertically and having a valve outlet opposite the head portion;

b) a sleeve having a first opening in fluid communication with the storage tank and a second opening adapted to receive the head portion of the valve stem, said sleeve also having a sleeve bore extending vertically between the first and second opening;

c) a securing means for securing the head portion of the valve stem to the second opening of the sleeve;

d) a main body capable of being fixed to the storage tank, said main body having a cylindrical vertical bore extending the length thereof adapted to slidably engage with the sleeve;

e) a compression spring acting between the main body and the sleeve, whereby said spring is pressing upwardly against the main body and is pressing downward against the sleeve; and f) a hollow vent tube having a top portion provided with a vent opening and a bottom portion provided with at least one aperture to provide for the evacuation of air contained in the container, said vent tube extending from the valve outlet coaxially with the body, sleeve and valve stem and being affixed to the main body, said vent tube also having a shoulder above the aperture for sealing the valve outlet when external force to the spring is not being applied.

2. The filling valve of claim 1, wherein the securing mean further comprises:

a) an externally threaded portion provided on the sleeve; and b) a sleeve nut being internally threaded to engage the externally threaded portion of the sleeve, said sleeve nut having an opening at its center for the passage of the tubular portion of the valve stem.

3. The filling valve of claim 2, wherein the sleeve bore further comprises:

a) a first conical sleeve portion having a diameter greater than one inch;

b) a cylindrical sleeve portion having a diameter greater than one inch;

c) a second tapered conical sleeve portion having a diameter greater than half inch; and d) said sleeve portions having smooth and tapered surfaces for reducing liquid turbulence.

4. The filling valve of claim 3, wherein the valve stem bore further comprises:

a) a conical valve stem portion having a diameter greater than half inch;

b) a cylindrical valve stem portion having a diameter greater than half inch; and c) said valve stem portions having smooth and tapered surfaces for reducing liquid turbulence.

* * * * *